United States Patent [19]

Giardini

[11] 4,373,671

[45] Feb. 15, 1983

[54] ELECTROMAGNETIC FUEL INJECTOR

[75] Inventor: Dante S. Giardini, Dearborn Hgts., Mich.

[73] Assignee: Ford Motor Company, Dearborn, Mich.

[21] Appl. No.: 253,458

[22] Filed: Apr. 13, 1981

[51] Int. Cl.[3] ..... B05B 1/30

[52] U.S. Cl. ..... 239/585

[58] Field of Search ... 239/87, 585, 453, 533.2–533.12; 251/139, 141

[56] References Cited

U.S. PATENT DOCUMENTS

| | | | |
|---|---|---|---|
| 1,162,789 | 12/1915 | Loane . | |
| 1,208,908 | 12/1916 | Burch . | |
| 1,376,277 | 4/1921 | Higgins . | |
| 1,856,852 | 5/1932 | Palisca . | |
| 1,902,197 | 3/1933 | Thaheld . | |
| 2,052,459 | 8/1936 | Geiser | 239/107.2 |
| 2,055,580 | 9/1936 | Larsson et al. . | |
| 2,332,909 | 10/1943 | Fuscaldo | 137/139 |
| 2,385,239 | 9/1945 | Unsworth | 123/139 |
| 2,530,128 | 11/1950 | Mashinter . | |
| 2,602,702 | 8/1952 | Kovach . | |
| 2,703,562 | 3/1955 | Seubert | 123/139 |
| 2,879,753 | 3/1959 | McKinley | 123/25 |
| 2,917,034 | 12/1959 | Bessiere | 123/139 |
| 3,005,118 | 10/1961 | Ranseen | 310/49 |
| 3,081,758 | 3/1963 | May | 123/139 |
| 3,456,628 | 7/1969 | Bassot et al. | 123/32 |
| 3,662,987 | 5/1972 | Schlagmuller et al. | 251/139 |
| 3,680,782 | 8/1972 | Monpetit et al. | 239/96 |
| 3,702,683 | 11/1972 | Sturmer | 239/585 |
| 3,802,626 | 4/1974 | Regneault et al. | 239/96 |
| 3,839,943 | 10/1974 | Ufnalewski | 91/454 |
| 3,882,833 | 5/1975 | Longstaff et al. | 123/90.11 |
| 3,967,597 | 7/1976 | Schlagmuller | 251/139 X |
| 4,062,327 | 12/1977 | Knights | 239/87 X |
| 4,097,833 | 6/1978 | Myers | 335/261 |
| 4,116,389 | 9/1978 | Furtah et al. | 239/585 |
| 4,197,996 | 4/1980 | Giardini | 239/87 |
| 4,247,044 | 1/1981 | Smith | 239/585 |

FOREIGN PATENT DOCUMENTS

| | | |
|---|---|---|
| 2419425 | of 0000 | Fed. Rep. of Germany . |
| 7834707 | of 0000 | Fed. Rep. of Germany . |

*Primary Examiner*—John J. Love
*Assistant Examiner*—Gene A. Church
*Attorney, Agent, or Firm*—Peter D. McDermott; Roger L. May

[57] ABSTRACT

A fuel injector 10 includes a housing 12 which mounts a valve 56 closing off orifice 22 at one end of a fuel chamber 20 bounded at an opposite end by a piston 18 which is controlled by a tubular armature 16. The tubular armature 16 fits within an annular gap 40 without the housing 12 and is actuated by a coil 14. A pressure compensation vent 78 is in communication with a section 50 at the upper side of piston 18 to partially compensate for chamber combustion pressures which exert a closing force on valve 56. Energizing of the drive coil 14 moves the armature 16 which in turn moves the piston 18 downward which displaces fuel within the fuel chamber 20 which opens the valve 56 allowing fuel to pass through orifice 22.

19 Claims, 2 Drawing Figures

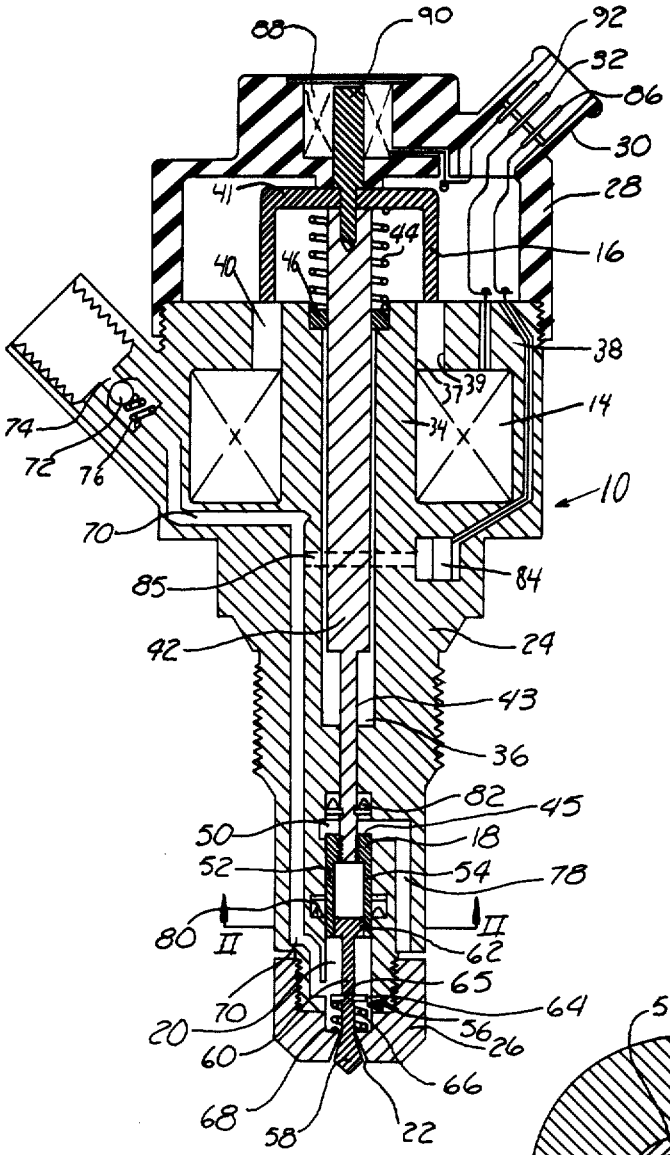
FIG. I
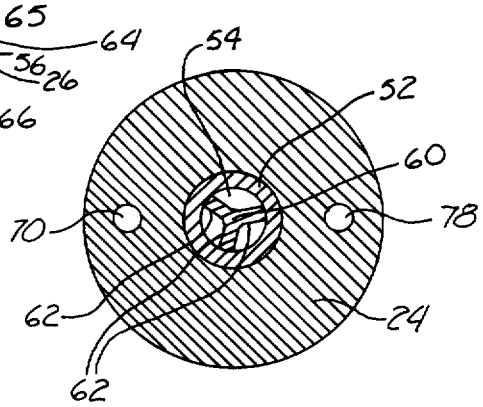
FIG. II

ELECTROMAGNETIC FUEL INJECTOR

BACKGROUND OF THE INVENTION

1. Field of the Invention

This invention relates in general to an internal combustion engine fuel injector assembly. More particularly, it relates to the construction of a fuel injector assembly that injects the fuel charge by the actuation of an electromagnetic assembly.

2. Disclosure Information

It is desirous to have an electromagnetically actuated injector that has a practically sized (i.e., smaller) coil and armature assembly that displaces fuel out through an orifice. Such a coil and armature assembly should be accurately controlled so that the amount of fuel can be precisely controlled with each injection.

Electromagnetically actuated fuel injection valves are known. U.S. Pat. No. 2,332,909 issued to Fuscaldo on Oct. 26, 1943 discloses an example of an electromagnetically actuated valve in combination with fuel displacement pistons. Combustion pressures drive the displacement piston while the armature opens and closes a valve.

U.S. Pat. No. 4,097,833 discloses a tubular armature and coil assembly. The armature fits within an annular groove in a housing surrounding the coil.

SUMMARY OF THE DISCLOSURE

My invention is an improvement of my Constant Pressure Fuel Injector Assembly described in U.S. Pat. No. 4,197,996 issued Apr. 15, 1980. My U.S. Pat. No. 4,197,906 discloses the general concept of a pressure compensated injection valve which uses the combustion chamber pressures to assist the discharge of fuel through the outlet orifice of the injector. The disclosed embodiment has an electromagnetic assembly which controls a fuel control valve and a spring that operates a fuel displacement piston. The gas pressure in the combustion chamber is exerted upon the piston to cancel the effects of the combustion chamber pressures exerted on the fuel at the outlet orifice when the valve is open. I incorporate the teachings of the above-identified patent by reference to the present disclosure.

According to the preferred embodiment of the present invention, a fuel injector for use in a combustion chamber of an internal combustion engine has an electromagnetic assembly having a moveable armature operably connected to a piston dividing a cavity in a housing into a first and second section. The first section of the cavity is in communication with the gas pressures within the combustion chamber and the second section is in communication with both an outlet orifice leading to the combustion chamber and a pressurized fuel source. The outlet orifice has a normally closed fuel flow control valve.

Preferably the armature is tubular and is received in an annular gap adjacent a coil within the housing. Springs bias both the tubular armature and the control valve to first and closed positions respectively. In addition, it is preferable to have a pressure sensor in communication with the second cavity section to sense pressures of the fuel which correlate with the pressures within the combustion chamber. A feedback position sensor is mounted in the housing to sense the position of the armature.

In broader terms, one aspect of the invention includes a fuel injector having an electromagnetic assembly with the armature connected to a fluid driving means with the fluid driving means dividing the cavity into a first and second section; the first section being in pressure communication with the combustion chamber and the second section in communication with a pressurized fuel source and the outlet orifice. The fuel flow control valve is moveable to open and close the outlet orifice. The fuel control valve and armature have means for biasing them to a first position to close the outlet orifice. Energizing of the coil moves the armature to a second position causing the fluid displacement means to positively displace the fuel in the cavity such that opening of said fuel flow control valve allows fuel to pass through the orifice.

Another aspect of the broader invention includes a fuel injector that has an electromagnetic assembly having a tubular armature receivable in an annular gap in a ferrous injector housing. The energizing of the assembly operably moves the armature a predetermined amount in a linear relation with the amount of current passing through the assembly.

BRIEF DESCRIPTION OF THE DRAWINGS

Reference now will be made to the accompanying drawings in which:

FIG. 1 is a cross-sectional view of a fuel injector assembly embodying the invention; and FIG. 2 is a cross-sectional view along lines II—II shown in FIG. 1.

DETAILED DESCRIPTION OF THE PREFERRED EMBODIMENT

Looking particularly to FIG. 1, the fuel injector 10 has a housing 12 which houses an electromagnetic coil 14 that drives an armature 16. The armature is operably connected to a piston 18 which drives fluid that is within a defined chamber 20 out through an outlet orifice 22.

More specifically, the housing 12 includes a body portion 24, a lower end cap 26 and an upper end cap 28. The body portion 24 is made from an electromagnetically conductive material such as steel or other ferrous material. The upper end cap 28 is made from a nonferrous material such as plastic. The upper end cap 28 has an electrical adapter outlet 30 housing an electrical connection 32 to the electromagnetic coil 14. The body portion 24 functions as an electromagnetic core having a central core section 34 which surrounds a bore 36 axially extending through said body portion. The body portion 24 also has an outer core section 38 which surrounds said coil 14. The core sections have pole surfaces 37 and 39 which define an annular gap 40. The poles 37 and 39 are surfaces arranged such that infinitesimal radially aligned surfaces of the respective poles are parallel.

The armature 16 is cup shaped with a tubular portion constructed to be received within the gap 40. The armature 16 has an end wall 41 rigidly connected to a shaft 42 that extends axially through the bore 36. A spring 44 is interposed between the end wall 41 and a spring seat 46 to bias the armature 16 in an upward direction as shown in FIG. 1.

The shaft 42 has a narrow diameter stem portion 43 that connects the armature 16 to the piston 18. The piston 18 has an outside diameter greater than the portion 43 of shaft 42 to form an annular surface area 45 thereabout. The piston 18 divides the bottom section of the bore into the before mentioned fluid containing chamber 20 and a pressure responsive chamber 50. The piston 18 has cylindrical wall section 52 extending downward to form a cavity 54 therein which is part of the fluid containing chamber 20.

A fuel control valve 56 has a valve head 58 which closes outlet orifice 22. A stem 60 extends upward from lead 58 and has its upper end received within the cavity 54 of the piston 18. The stem 60 has, as shown clearly in FIG. 2, three radially extending integral flanges 62 which slideably engage the inner surface of the cylindrical wall 52 of piston 18.

Below the flanges 62, a retaining collar 64 is affixed to stem 60 at an annular groove 65. A spring 66 is compressed between the collar 64 and an inner surface 68 of the bottom end cap 26 such that the spring 66 biases the fuel flow control valve 56 upward to a closed position.

The fluid containing chamber 20 communicates with conduit 70 which leads to a one-way check valve 72. The check valve 72 is normally biased to a closed position by a spring 76 but can be opened to allow fuel to flow through an inlet port 74 into the conduit 70 and chamber 20. The inlet port is connected to a low pressure fuel source (not shown).

The pressure chamber 50 is connected to a vent opening 78 in communication with the pressure within the engine's combustion chamber. The injector housing 12 in this case is adapted to be mounted with the end 26 of the injector extending into the combustion chamber of an engine for injecting fuel directly therein.

To prevent leakage of pressurized fuel from chamber 20 and combustion gases from chamber 50, an annular teflon lip seal 80 fits around the cylindrical wall 52 of piston 18 and a second annular teflon lip seal 82 fits about the stem 43 of shaft 42 above the pressure chamber 50.

In addition, a piezoelectrical pressure sensor 84 is mounted in the housing in fluid communication with chamber 20 to read pressures therein via conduit 70 and conduit branch 85. An electrical connection 86 is mounted within adapter 30 and connected to the sensor 84. In addition, a feedback position sensor 88 is mounted above the tubular armature within the upper end cap 28 to read the axial position of the top end 90 of shaft 42. An electrical connection 92 is mounted within adapter 30 and connected to the sensor 88.

OPERATION

The purpose of the injector 10 is to inject fuel into a combustion chamber of an internal combustion engine. In general, a low pressure fuel source fills chamber 20, piston 18 is displaced, and fuel passes through the orifice 22 when the valve 56 is open.

More specifically, check valve 72, which is normally closed, opens when piston 18 moves upwardly to fill conduit 70 and chamber 20 with fuel from the low pressure fuel source.

The spring 66 maintains the valve 56 in a normally closed position against the pressurized fuel introduced through the inlet 74. The piston 18 is normally biased in an upward position.

As soon as the engine piston completes an induction stroke and proceeds into a compression stroke, the buildup of combustion chamber pressure is sensed through vent 78 against the upper side of piston 18. The pressure felt by the upper side of piston 18 is the same pressure exerted on the valve head 58.

At an appropriate time, an electric current is sent through an electrical connection 32 to the coil 14. Upon energizing of the coil 14, the armature 16 is forced into the annular gap 40 against certain forces. A first force is the force exerted by spring 44. A second force is exerted by the fuel pressure in the chamber 20 exerted on the cross-sectional area of the piston 18.

The movement of armature 16 causes the piston 18 to move downward to diminish the size of the fuel containing chamber 20 to cause a pressurizing of the fuel within the fuel chamber 20. The pressurizing of the fuel forces open the valve 56 and allows the fuel to pass through the outlet orifice 22. The fuel pressure needed to open valve 56 is determined by; firstly, the strength of spring 66 and secondly by the gas pressures in the combustion chamber acting on valve head 58.

Upon deenergizing of the coil 14, spring 44 lifts the armature 16 and the piston 18 upwardly. The pressure of the fuel in the cavity is thereby reduced to allow the spring 66 to close the valve 56. In addition, low pressurized fuel can pass through the check valve 72 at the inlet port 74 to refill the fuel chamber 20 as the piston 18 moves upwardly.

Many advantages and functional features are possible by the above-described fuel injector. Firstly, utilizing a pressure compensation vent 78 produces a pressure upon the piston 18 which partially counteracts the combustion chamber pressures exerted at the outlet orifice 22 that urge the valve 56 to a closed position and retards fuel from passing through the orifice. As a result, a reduction in the strength and consequently the size of the coil 14 and armature 16 are feasible. The size reduction makes the use of an electromagnetic assembly practical in forcing the fuel that is within the chamber 20 out through the orifice.

Secondly, a further advantage arises by utilizing the cup shaped armature 16 as the means to force fuel from the chamber 20 through orifice 22 as well as the means to force open the valve head 58. Not only can the timing of the stroke be controlled but also the extent of the piston 18 stroke can be controlled by using a tubular shaped armature 16 and an annular gap 40. The gap 40 defined by the pole surfaces 37 and 39 that have their infintessimal sections geometrically parallel has a magnetic field passing therethrough which is substantially perpendicular to the pole surfaces. The force exerted on the tubular armature 16 by the current and magnetic field is linearly dependent on the amount of current passing through the coil 14. Consequently, the current can be controlled which in turn controls the distance which the armature 16 is moved within the gap 40 against the force of the return spring 44 and combustion pressures. In this fashion, if less than a full stroke of the piston 18 is desired, the current in the coil 14 can be reduced to the desired amount. This is particularly useful when the engine is idling.

A third and fourth advantage occurs by separating the fuel control valve 56 from the piston 18. The valve 56 is able to close at the time the stroke of piston 18 ends. The valve 56 does not need to remain open until the piston 18 is returned upward to its first position. This allows a faster closing of the valve 56 even before the coil 14 is de-energized. Furthermore, the opening stroke of valve stem 60 is shorter than the full stroke of piston 18. This provides further durability of valve 56.

In addition, the introduction of a pressure sensor 84 operably connected to the chamber 20 allows pressures to be sensed which directly correlate with the pressures in the combustion chamber since these pressures are transferred through the piston 18 and are exerted on the fuel contained with the chamber 20 and conduit 70 and conduit branch 85. The advantage here is that combustion chamber pressures can be sensed without a sensor being exposed directly to the high temperatures that occur within the combustion chamber. In this fashion, the combustion pressures can be used as a parameter in a logic control circuit which controls the electric current to coil 14.

In addition, a feedback position sensor which is incorporated into the upper end cap 28 can indicate the position of the armature 16 and the position of the piston 18 which in turn can be fed to a logic circuit which would control the timing and amount of energy given to the coil 14. The use of feedback sensor renders a more accurate fuel injection system by providing a further input to the logic control circuit.

In this fashion, a pressure compensated injector can be constructed to include an electromagnetic driving assembly which accurately delivers fuel to a combustion chamber of an internal combustion engine and can be controlled to vary the amounts of fuel and time at which the fuel is delivered.

Variations and modifications of the present invention are possible without departing from its spirit and scope as defined by the appended claims.

The embodiments in which an exclusive property or privilege is claimed are defined as follows:

1. A fuel injector for use in a combustion chamber of an internal combustion engine; said injector characterized by:

a housing having a cavity therein with a fuel outlet orifice and a fuel inlet port being in communication with said cavity;

a fuel flow control valve moveable to block or permit fuel flow through the orifice;

a fuel flow control valve spring means for moving said valve to a closed position;

a fuel displacement means in said cavity and dividing said cavity into first and second sections, said first section being in pressure communication with said combustion chamber and said second section in communication with said fuel flow control valve;

a one-way check valve mounted at said inlet port, said check valve being able to open to permit an inflow of fuel into said second section of said cavity and being able to close to permit a buildup of pressure in said other section of said cavity when the control valve is in its closed position;

an electromagnetic assembly mounted within said housing having a coil and armature;

said housing defining first and second substantially parallel pole surfaces defining a gap adjacent said coil;

a magnetic field passing transversely through said gap when said coil is energized;

said armature received in said gap;

said armature being connected to said fluid driving means;

an armature spring means urging said armature to a first position;

said armature being moveable to a second position when said coil is energized to operably move said fuel displacement means to displace the fuel which opens said fuel flow control valve;

combustion chamber pressure in said first section applying a force on said displacement means to displace said fuel within said second section; said force counteracting in part any force exerted by the combustion chamber pressures on said valve and on fuel within said second section when said valve is open that works against displacing of fuel by said displacement means.

2. A fuel injector as defined in claim 1 wherein:

said fuel displacement means is a piston slideably mounted in said cavity and connected to said tubular armature by a shaft connected at opposite ends to said piston and armature;

said piston having an annular area exposed to the pressures in said combustion chamber.

3. A fuel injector as defined in claim 2 further comprising said piston being cup-shaped defining a hollow space with said fuel flow control valve having a guide stem slideably received in said hollow space;

said hollow space being filled with fuel.

4. A fuel injector as defined in claim 1 further comprising a pressure sensor operably mounted to sense pressure of fuel in said second cavity section, said pressure correlating to the pressure in said combustion chamber.

5. A fuel injector as defined in claim 1 further comprising said pole surfaces forming concentric cylindrical walls defining said gap in between to be annular in shape; said armature having an annular section receivable within said annular gap.

6. A fuel injector as defined in claim 4 further comprising:

a feedback position sensor mounted within said housing to sense the axial position of said armature.

7. A fuel injector for use in a combustion chamber of an internal combustion engine said injector characterized by:

said injector having a cavity with a fuel outlet orifice and fuel inlet port;

a fuel flow control valve moveable to a closed position with respect to said outlet orifice or an open position to permit fuel flow through the orifice;

said inlet port constructed to be in fluid communication with a fuel source to permit an inflow of fuel into said cavity and to permit a buildup of pressure in the cavity;

a fuel displacement means in said cavity;

an electromagnetic assembly comprising a coil, an electric conducting core and a tubular armature;

said core defining an annular gap axially adjacent said coil sized to receive said tubular armature;

means for urging said armature to a first position and said valve to its closed position;

means for opening said fuel control valve;

said fluid displacement means operably connected to said tubular armature;

said armature being moveable to a second position when said coil is energized to operably move said fluid displacement means to displace the fuel such that when said fuel flow control valve is open said fuel flows out through said outlet orifice;

the current passing through the coil bearing a linear relation with the distance the armature moves from its first position to its second position within said annular gap against the means for urging the armature to said first position.

8. A fluid injector as defined in claim 7 wherein said tubular armature comprises:

a tubular section connected to an end portion which is connected to a central shaft section;

said tubular section being receivable in said annular gap;

said central shaft section operably connected to said fluid displacement means.

9. A fuel injector as defined in claim 7 wherein said fluid displacement means is a piston slideably mounted in said cavity to increase fuel pressure in said cavity;

said fluid displacement means constructed to increase the pressure of fuel in said cavity; said fuel exerting a force on said flow control valve that urges said valve to said open position.

10. A fuel injector as defined in claim 7 wherein fluid displacement means divides said cavity into first and second sections; said first section being in pressure communication with said combustion chamber and said second section in communication with said fuel flow control valve;

combustion chamber pressure in said first section applying a force on said displacement means to displace said fuel within said second section; said force counteracting in part any force exerted by the combustion chamber pressures on said valve and on fuel within said second section when said valve is open that works against displacing of fuel by said displacement means.

11. A fuel injector as defined in claim 7 further comprising:

a feedback position sensor mounted within said housing to sense the axial position of said armature.

12. A fuel injector as defined in claim 11 further comprising a pressure sensor operably mounted to sense pressure of said fuel in said second cavity section which correlates to the pressure in said combustion chamber.

13. A fuel injector for use in a combustion chamber for an internal combustion engine; said injector characterized by:

said injector having a cavity with a fuel outlet orifice and fuel inlet port;

a fuel flow control valve moveable to a closed position with respect to said outlet orifice or an open position to permit fuel flow through the orifice;

a fuel displacement means in said cavity and dividing said cavity into first and second sections;

said first section being in pressure communication with said combustion chamber and said second section in communication with said fuel flow control valve;

said inlet port constructed to be in fluid communication with a fuel source to permit an inflow of fuel into said second section of said cavity and to permit a buildup of pressure in said second section of said cavity;

an electromagnetic assembly having an armature being connected to said fuel displacement means;

means for urging said armature to a first position and said valve to its closed position;

means for opening said fuel flow control valve;

said armature being moveable to a second position when said electromagnetic assembly is energized to operably move said fuel displacement means to displace the fuel within said cavity such that when said fuel flow control valve is in its open position, fuel flows out through said outlet orifice;

said pressure within said combustion chamber operably acting on the fuel displacement means in opposing directions;

combustion chamber pressure in said first section applying a force on said displacement means to displace said fuel within said second section; said force counteracting in part any force exerted by the combustion chamber pressures on said valve and on fuel within said second section when said valve is open that works against displacing of fuel by said displacement means.

14. A fuel injector as defined in claim 13 wherein said fuel displacement means is a piston slideably mounted in said cavity to displace fuel in said cavity;

said fuel displacement means being constructed to increase the pressure of fuel in said second section of said cavity, said fuel exerting a force on said flow control valve that urges said valve to said open position.

15. A fuel injector as defined in claim 13 further comprising:

a feedback position sensor mounted within said housing to sense the axial position of said armature.

16. A fuel injector as defined in claim 15 wherein said fuel displacement means is a piston slideably mounted in said cavity to displace fuel in said cavity;

said fuel displacement means being constructed to increase the pressure of fuel in said second section of said cavity, said fuel exerting a force on said flow control valve that urges said valve to said open position.

17. A fuel injector as defined in claim 14 wherein said fuel control valve slideably engages said fuel displacement means.

18. A fuel injector as defined in claim 13 further comprising a pressure sensor operably mounted to sense pressure of fuel in said second cavity section, said pressure correlating to the pressure in said combustion chamber.

19. A fuel injector for use in a combustion chamber of an internal combustion engine, said injector being characterized by:

said injector having a cavity with a fuel outlet orifice;

said cavity being constructed to be in communication with a pressurized fuel supply;

a fuel flow control valve normally closing said orifice and moveable to an open position with respect to said orifice;

fuel displacement means in said cavity dividing said cavity into first and second sections;

said first section being in communication with said combustion chamber and said second section being in communication with said fuel flow control valve;

said fuel displacement means being displaceable to increase the pressure of the fuel in said second section;

said fuel flow control valve being moveable to said open position in response to a predetermined pressure differential between the fuel in said second section and the combustion chamber pressures;

combustion chamber pressure in said first section applying a force on said fuel displacement means to increase the pressure of the fuel in said second section; said force counteracting, in part, any force exerted by the combustion chamber pressures on said valve and on fuel within said second section when said valve is open that works against the displacing of fuel by said displacement means;

an electromagnetic assembly having an armature displaceable between an at-rest position and an actuated position;

said fuel displacement means being displaced in response to displacement of said armature from said at-rest position to said actuated position;

said armature being moveable to said actuated position in response to energizing of said electromagnetic assembly whereby said fuel pressurizing means is displaced, the pressure of the fuel in said second section is increased to create said predetermined pressure differential, said fuel flow control valve is moved to said open position and fuel is expelled through said orifice.

* * * * *